US005879250A

United States Patent [19]

Tähtinen et al.

[11] Patent Number: 5,879,250

[45] Date of Patent: Mar. 9, 1999

[54] STICK HANDLE FOR AN ICE HOCKEY STICK OR FOR A STICK INTENDED FOR A GAME OF SIMILAR TYPE

[75] Inventors: Olli Tähtinen, Jokioinen; Perttu Lilja, Tammela, both of Finland

[73] Assignee: KHF Sports Oy, Forssa, Finland

[21] Appl. No.: 752,473

[22] Filed: Nov. 19, 1996

[30] Foreign Application Priority Data

Jul. 11, 1996 [FI] Finland ..... 964474

[51] Int. Cl.[6] ..... A63B 59/14

[52] U.S. Cl. ..... 473/561

[58] Field of Search ..... 473/560, 561, 473/189

[56] References Cited

U.S. PATENT DOCUMENTS

| | | | |
|---|---|---|---|
| 2,040,132 | 5/1936 | Hall | 473/560 |
| 4,124,208 | 11/1978 | Burns | 473/562 |
| 5,603,498 | 2/1997 | Crawford et al. | 473/562 |

FOREIGN PATENT DOCUMENTS

| | | | |
|---|---|---|---|
| 1151693 | 8/1983 | Canada | 473/189 |
| 1180728 | 1/1985 | Canada | A63B 59/12 |
| 2061778 | 5/1973 | Germany | 473/189 |
| 1121051 | 7/1968 | United Kingdom | 473/189 |

*Primary Examiner*—Mark S. Graham
*Attorney, Agent, or Firm*—Steinberg & Raskin, P.C.

[57] ABSTRACT

A stick handle for an ice hockey stick having a longitudinal central axis, an upper end and a lower end, the lower end being situated adjacent to the blade of the stick. The handle comprises a core part and at least one cover plate fixed to the core part. The core part has a substantially rectangular cross-section and at least one recess formed therein in at least one side of the core part. The cover plate is situated on the side of the core part wherein the recess is formed such that at least one closed cavity is formed in the handle.

20 Claims, 6 Drawing Sheets

FIG. 3
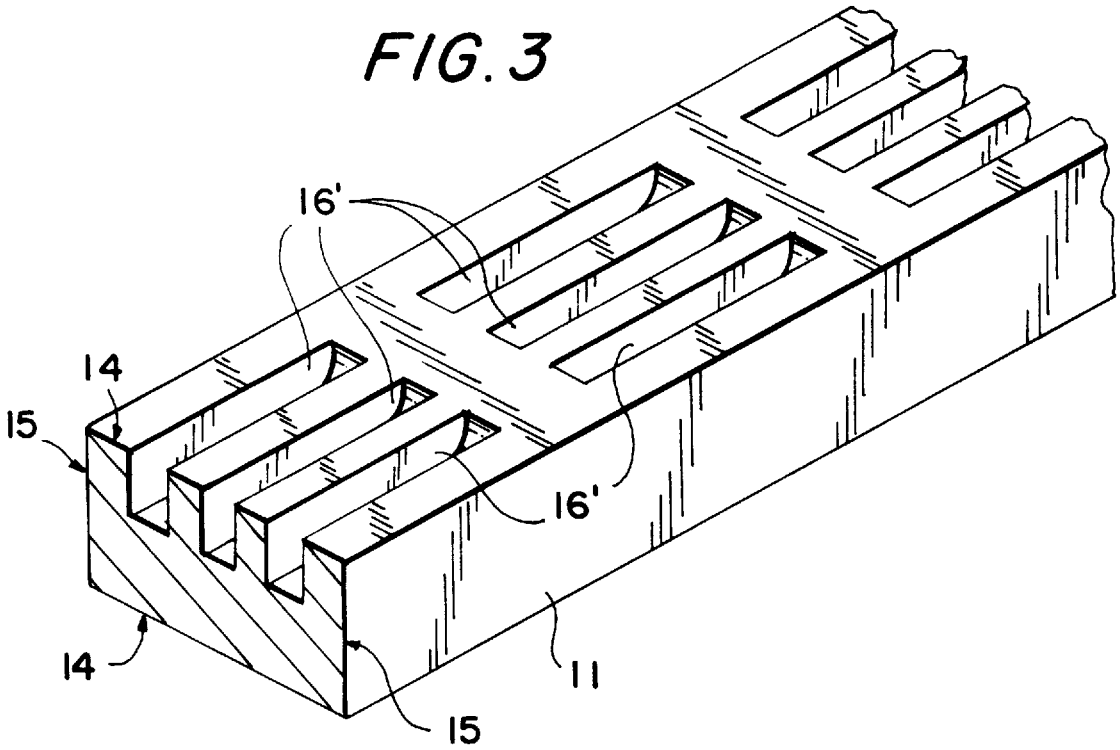
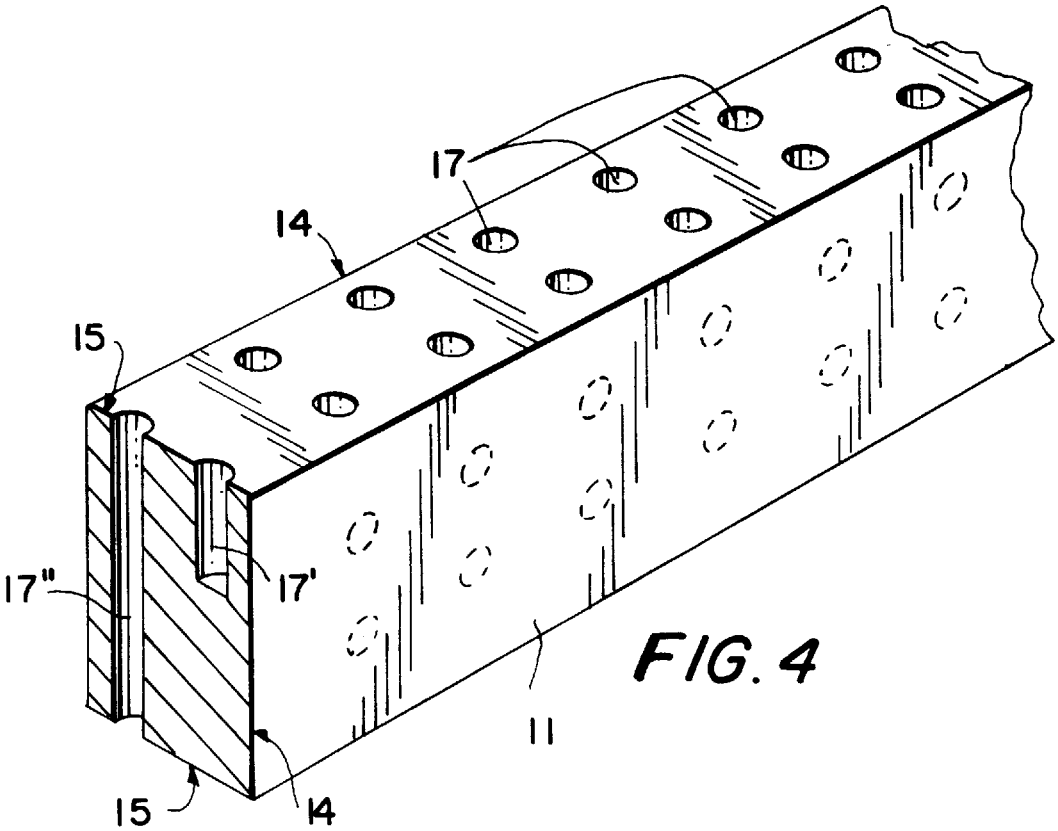
FIG. 4

STICK HANDLE FOR AN ICE HOCKEY STICK OR FOR A STICK INTENDED FOR A GAME OF SIMILAR TYPE

BACKGROUND OF THE INVENTION

The invention concerns a stick handle for an ice hockey stick or for a stick intended for a game of similar type. The handle comprises an oblong core part of a substantially rectangular section as well as at least one oblong cover plate fitted on at least one side of the core part and/or a coating band or a coating that surrounds the handle substantially.

In the game of ice hockey, the stick is subjected to very high strains, and, therefore, it has been an aim to make the handle of the ice hockey stick as strong and durable as possible. Traditionally the handles of ice hockey sticks were made of wood so that the handle was made of solid wood and formed as one piece. From this the stick handle was developed further, and, in an attempt to achieve high strength, handles were also produced that were made of a number of wood veneers glued together, of laminated wood board, or equivalent. Later, the stick handle started being coated with a laminate, in particular with fiberglass laminate, which was either glued onto the handle face or wound directly onto the wooden handle. In order to make the laminate adhere to the handle better, very shallow grooves were formed into the face of a smooth handle, which grooves were filled with the coating, such as fiberglass laminate, during the coating process.

A second important and desirable property of ice hockey sticks is to have the weight of the handle be as low as possible while, nevertheless, not reducing the strength. In an attempt to achieve low weight, stick handles were made hollow and tubular, and materials that were used included, for example, aluminum or some high-strength composite material suitable for the purpose. In some cases, this hollow handle was further filled with a foamy material, such as polyurethane or equivalent. Also in the cases of wooden handles, a weight as low as possible was aimed at, in which case the wooden handle was made of several parts so that an oblong cavity space remained in the handle. One such handle of an ice hockey stick has been described in, for example, Canadian Patent No. 1,180,728.

OBJECTS AND SUMMARY OF THE INVENTION

The object of the present invention is to provide a novel stick handle for an ice hockey stick or for a stick intended for a game of similar type, which handle is as strong as possible and of a weight as low as possible and which handle is further, from the point of view of the technique of manufacture, as simple as possible, so that the cost of manufacture does not differ from the present cost level to a substantial extent. In view of achieving this, the invention is mainly characterized in that the weight of the construction of the core part has been reduced so that, at least at one side of the core part, at least one recess has been formed which extends from said side into the material of the core part and which is open outwards, said recess being covered from outside with said cover plate and/or with a coating or a coating band so that at least one closed cavity space or equivalent is formed in the handle.

In addition to an ordinary ice hockey stick, the construction in accordance with the present invention can also be employed, for example, in an ice hockey goalkeeper's stick, in a rink bandy stick, or in other sticks intended for a game of similar type. The construction in accordance with the invention is particularly well suitable for a goalkeeper's stick and for a rink bandy stick, for, as a rule, in said sticks a handle construction to a great extent similar to an ice hockey stick is used, while the handle portion is just shorter than in an ordinary ice hockey stick.

By means of the present invention, considerable advantages are obtained over the prior art, and it is a first advantage that the handle in accordance with the invention has a weight considerably lower than the weight of a conventional construction. From the point of view of the technique of manufacture, it is to be considered an advantage that, compared with a corresponding conventional stick, the stick of the present invention requires, at the maximum, just one additional step of work. However, the handle can also be formed so that, compared with the prior art, no additional step of work is needed at all. It is a further significant advantage that, with a handle construction of the present invention, the center of equilibrium of the stick can be placed readily in the correct point. The further advantages and characteristic features of the invention will come out from the following detailed description of the invention.

BRIEF DESCRIPTION OF THE INVENTION

The invention will be described in the following by way of example with reference to the figures in the accompanying drawing.

FIGS. 3 and 4 illustrate alternative constructions of the core part in the handle of an ice hockey stick.

DETAILED DESCRIPTION OF THE INVENTION

Figure 1:
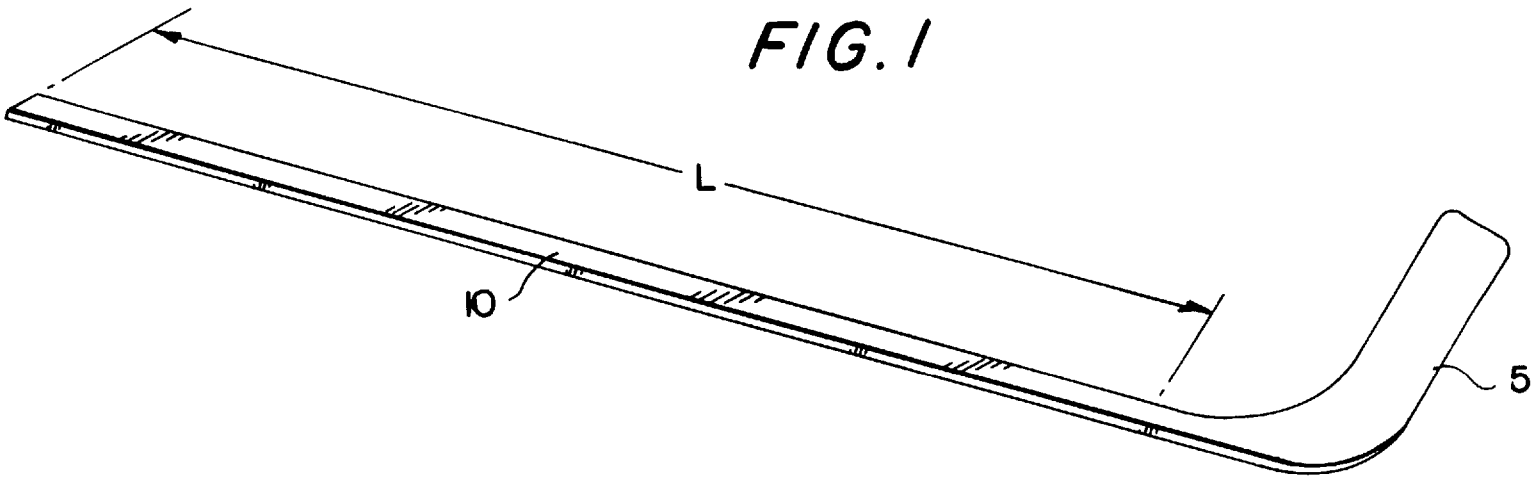
FIG. 1 is a fully schematic axonometric view of an ice hockey stick.
Figure 2:
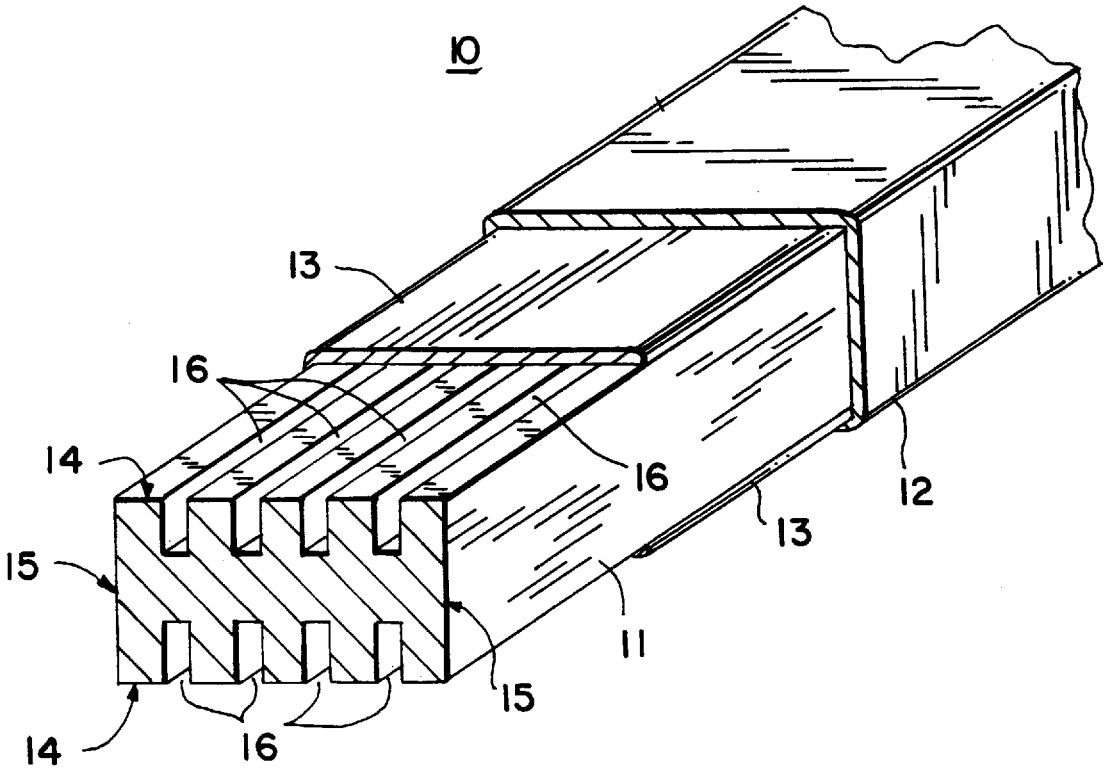
FIG. 2 is a schematic axonometric view partly in section of a part of the handle of an ice hockey stick.

Initially, reference is made to FIGS. 1 and 2, in which the stick handle is denoted generally with the reference numeral 10. As is shown in FIG. 1, the handle 10 has a certain length L, and the blade 5 of the stick has been fixed to the lower end of the handle. The construction of the handle 10 shown in FIG. 2 consists of a substantially rectangular core part 11, which has two narrower sides 15 and two wider sides 14. The material of the core part 11 is most appropriately wood, even though some inorganic material, such as, for example, polyurethane (PU) or polyvinyl chloride (PVC), can be used as a material for the core part. In the embodiment shown in FIG. 2, thin cover plates 13 have been fitted onto the wide sides 14 of the core part 11, which cover plates 13 are preferably made of a laminate with reinforcement fibers, such as carbon fiber or fiberglass laminate, wood veneer, plywood, or equivalent. The cover plates 13 are preferably fixed onto the wide sides 14 of the core part 11 by gluing. Finally the handle has been covered with a suitable coating 12, which is preferably made of some laminate with reinforcement fibers, such as fiberglass laminate, carbon fiber laminate, wood veneer, plywood, or equivalent. The laminate 12 has been fixed onto the handle by gluing, winding, or in some suitable way. Thus, as the material of the topmost layer on the stick handle, it is possible to use either wood material or a laminate material with reinforcement fibers. The choice of the material of the topmost layer can be carried out based on the desired properties, such as the desired strength and/or the desired appearance.

In the respects described above, the construction of the handle 10 is to a great extent similar to the prior-art handles. As a novelty and in view of achieving a sufficiently low weight, in the embodiment of FIG. 2, longitudinal grooves 16 have been formed into the core part of the handle, which grooves have been machined, in FIG. 2, into both wide sides 14 of the core part. In the illustration of FIG. 2, there are four such grooves 16 in each wide side 14, but the number of the grooves 16 and so also their width, depth and shape can vary depending on the properties that are expected from the handle 10. In an attempt to fit the center of equilibrium of the stick at the desired point, the grooves have been formed into the core part 11 at least in the area of the lower end of the handle, i.e. in the end nearest the stick blade. The length of the grooves 16 depends on the desired properties, but the length is preferably substantially ⅔ of the length L of the handle 10. In the illustration of FIG. 2, the grooves 16 have been formed into the blank of the handle, i.e. into the core part 11, and, after that, cover plates 13, favorably made of wood veneer, have been glued onto the grooves.

The grooves that have been formed into the core part 11 do not necessarily have to extend continuously over the length of the handle, and attempts have been made to illustrate this by means of FIGS. 3 and 4. The core part 11 of the handle as shown in FIG. 4 has a construction in the other respects similar to that shown in FIG. 2, with the following exceptions. First, in the exemplifying embodiment of FIG. 3, the grooves 16' have been formed into one of the wide sides 14 of the core part only. It is a second and more remarkable difference that the grooves 16' are not continuous over the length of the handle, but the grooves consist of a number of short grooves 16' placed one after the other, between which there are ridges in the longitudinal direction of the handle. Thus, the grooves 16' are non-continuous. In an attempt to obtain a desired center of equilibrium, such a solution can be even considerably more favorable than the embodiment shown in FIG. 2, because the shorter component grooves can be arranged easily at any location whatsoever along the length of the handle. The grooves in FIG. 3 can, of course, also be formed into the opposite wide side 14 and/or into one or both of the narrow sides 15.

Further, FIG. 4 shows another embodiment of the construction of the core part 11. This embodiment differs quite considerably from the exemplifying embodiments described above. One of the main functions of the grooves described above was lowering the weight of the handle to a substantial extent. In the embodiment of FIG. 4 this has been accomplished so that no grooves have been formed into the core part 11 at all, but the reduction of weight or corresponding recesses have been produced by forming bores 17 into the core part. In the exemplifying embodiment shown in FIG. 4, differing from the exemplifying embodiments described earlier, the bores 17 have been formed into the narrow side 15 of the core part 11. Further, in FIG. 4 it is illustrated that the bores 17 can be formed, in the cross direction of the core part 11, as bores 17" extending fully through the core part, or the bores can be formed as bore holes 17' extending just partly into the core part 11, or as corresponding openings, whose depth can be, for example, similar to that shown in FIGS. 2 and 3. Nor do such bores 17", bore holes 17' or corresponding openings have to be arranged in continuous rows in the direction of length of the core part, but they can be arranged in accordance with any desired pattern. In the case of FIG. 4, it is even easier to find a suitable center of equilibrium, because the bores or equivalent can be formed readily in the desired locations over the length of the core part 11. Also in this embodiment, it is possible to form the bores into the opposite narrow side 15 and/or into one or both of the wide sides, either as through bores or as bore holes just partly penetrating into the core part 11.

Thus, FIGS. 5 to 10 show alternative solutions for the construction of the handle 10 illustrated in FIGS. 2 to 4.

Figure 5:
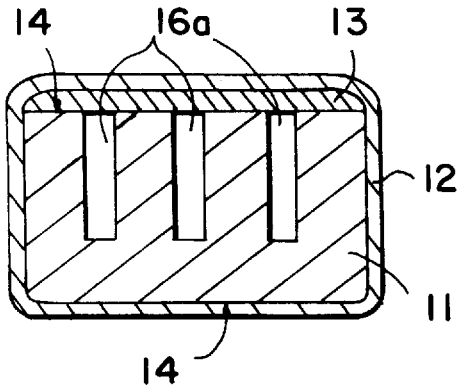
FIGS. 5 to 10 are schematic sectional views of different embodiments of the construction of the handle in accordance with the invention.

In the embodiment shown in FIG. 5, the handle construction consists of a core part 11, of grooves **16*a* that have been formed into one wide side only, of a cover plate 13 that covers said grooves, and of a coating 12 that surrounds the handle, such as fiberglass laminate or equivalent. As is shown in FIG. 5, the grooves 16*a* have, thus, been formed at one wide side 14 of the core part 11 only, in which case, as is shown in the figure, the grooves can be made considerably deep. Thus, in FIG. 5 it is illustrated that the number of the grooves 16*a*** can be chosen freely depending on the properties that the stick is supposed to have.

Figure 6:
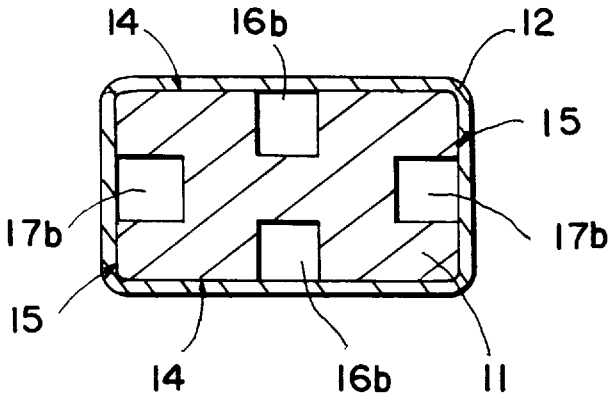

The embodiment shown in FIG. 6 differs to some extent from the constructions shown in the former illustrations. First, it is a substantial difference that, in the embodiment of FIG. 6, the grooves **16*b*, 17*b* have been formed into all sides of the core part 11, i.e. into both wide sides 14 and into both narrow sides 15. It is a second substantial difference compared with the former figures that onto the grooves 16*b*,17*b* no veneer or equivalent cover plate has been fixed by gluing, but the coating 12, such as a fiberglass laminate or equivalent, has been fitted directly onto the core part 11 to cover the grooves 16*b*,17*b*. Thus, in this illustration, attempts have been made also to illustrate that the cover plates 13** are not essential from the point of view of the present invention.

Figure 7:
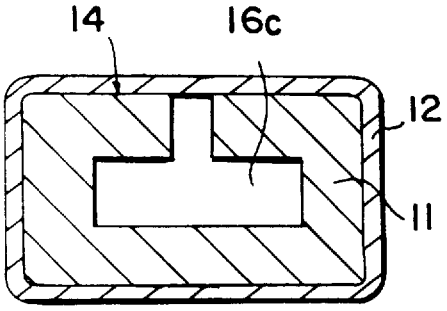

In FIG. 7, an embodiment of the handle is shown in which one backed-off groove has been formed into the core part 11 into one wide side 14 only, which groove is opened in the core part 11 into a wide cavity **16*c* or an equivalent channel in the direction of the handle. Onto the core part 11, the coating 12 has been fitted directly in a way similar to FIG. 6. From the point of view of the manufacture, formation of the backed-off groove 16*c* as shown in FIG. 7 into the core part 11 is not substantially more difficult than formation of the grooves shown in FIGS. 2 to 6**.

Figure 8:
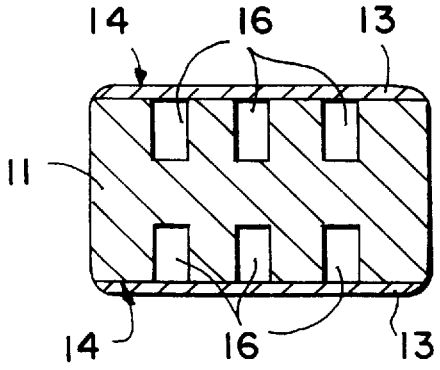

FIG. 8 shows an embodiment which is highly similar to the construction shown in FIG. 2. Thus, in this solution, into both of the wide sides 14 in the core part 11, grooves 16 parallel to the length of the handle have been formed. Onto the grooves 16, onto the wide sides 14 of the core part 11, veneers 13 or equivalent cover plates have been fixed by gluing. Thus, this embodiment differs from that shown in FIG. 2 in the respect that the coating has been omitted in this embodiment. Thus, when wood is used as the material, the outer appearance of the handle is fully similar to a conventional wooden handle.

Figure 9:
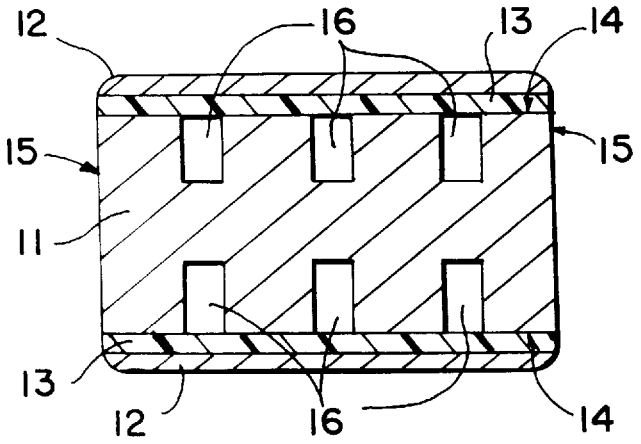

In FIG. 9 an embodiment of the construction of the handle of an ice hockey stick is shown which differs from those described above in certain respects. The core part 11 is highly similar to that already illustrated in FIG. 2, so that, in the exemplifying embodiment of FIG. 9, the grooves 16 or equivalent have been formed into both of the wide sides 14 of the core part 11. In this respect, the only difference compared with FIG. 2 is the number of the grooves 16, which is three in this embodiment. The number of grooves can, however, vary depending on the desired properties. Onto the wide sides 14 of the core part 11, cover plates 13 have been fixed, for example, by gluing onto the grooves 16, and further, onto the cover plates 13, a coating 12 has been fixed, likewise, for example, by gluing. Thus, in the embodiment shown in FIG. 9 the coating 12 does not cover or surround the whole handle, but it has been fitted just onto the cover plates 13, so that the coating 12 consists of a band. Further, in this embodiment, the material of the cover plates 13 is laminate with reinforcement fibers, such as fiberglass laminate or carbon fiber laminate or equivalent so as to provide the handle with the necessary strength, whereas, in this solution, the coatings 12 are made of a wood material, such as wood veneer, plywood, or equivalent, the outer appearance of the stick handle being similar to a typical wooden handle.

Figure 10:
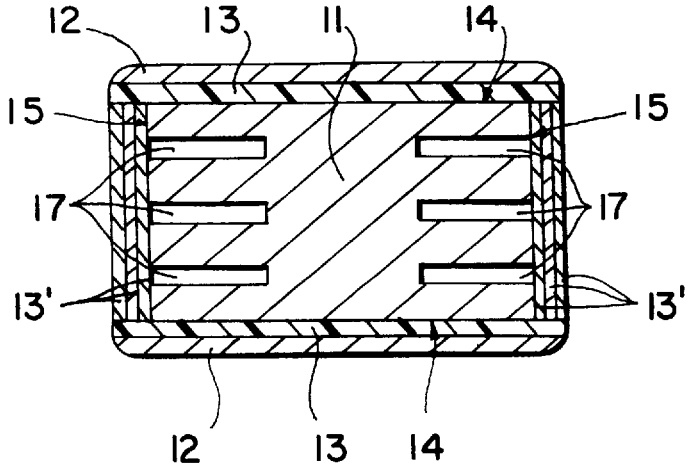

Finally, FIG. 10 shows a further embodiment of the construction of the handle of an ice hockey stick in accordance with the invention. In the solution of FIG. 10, grooves 17 or equivalent have been formed into the core part 11 into both of the narrow sides 15 of the core part. Onto the grooves 17, onto said narrow sides 15, further, several layers of cover plates 13' have been fixed, for example, by gluing. In FIG. 10, three layers 13' of cover plates placed one on the other are shown, but the number of the layers can be increased or reduced from what is shown in the figure. However, it has been noticed that three layers placed one on top of the other is the most appropriate number. The material of the cover plates 13' may vary in the way described above, in which case it is possible to use different materials in different layers. If an appearance of a "wooden handle" is aimed at, at least the outer layer must be of some suitable material, for example wood veneer. Further, in this exemplifying embodiment, also onto the wide sides 14 of the core part 11, first cover plates and onto said cover plates coating bands 12 have been fixed, for example, by gluing. In the illustration in the figure, the cover plates 13 are made of a laminate with reinforcement fibers, such as fiberglass laminate or carbon fiber laminate or equivalent, in view of achieving the necessary strength, and, on the other hand, the coatings 12 are made of a wood material, such as wood veneer or plywood. The sequence and/or the number of the laminate and wood-material layers can, however, be varied in the desired way and, thus, differ from the illustration in the figure. Such an embodiment is also fully possible in which just either one of the materials is used.

In the constructions described above, it has been described that the core 11 of the handle is substantially made of wood material. This is also a highly suitable material for use in a stick handle. However, in the cases in which the handle is provided with a strong coating 12, such as fiberglass laminate or equivalent, it is possible to contemplate that as the material for the core part it is possible to use, for example, some commonly used foam material, such as polyurethane (PU) or equivalent, for example polyvinyl chloride (PVC). However, as was stated above, the use of such a material requires a coating of quite a high strength.

Above, the invention has been described by way of example with reference to the figures in the accompanying drawings. The invention is, however, not confined to the exemplifying embodiments shown in the figures only, but different embodiments of the invention can show variation within the scope of the inventive idea defined in the accompanying patent claims.

We claim:

1. A stick handle for an ice hockey stick having a longitudinal central axis, a blade, an upper end and a lower end, the lower end being situated adjacent to the blade of the stick, said handle comprising:

a core part having a substantially rectangular cross-section, said core part having a plurality of continuous grooves formed in at least one side of said core part along at least a portion of the length of the hockey stick substantially parallel to the longitudinal axis of the hockey stick, said grooves being laterally adjacent to one another side by side; and at least one cover plate fixed to said at least one side of said core part thereby covering said grooves such that at least one closed cavity defined by said core part and said at least one cover plate is formed in the handle.

2. A stick handle according to claim 1, further comprising a coating which substantially surrounds the stick.

3. A stick handle according to claim 1, wherein said grooves are formed in two opposite sides of said core part.

4. A stick handle according to claim 1, wherein said grooves are formed at least substantially in the lower end of the handle.

5. A stick handle according to claim 1, wherein said grooves are formed substantially over ⅔ of the length of the handle.

6. A stick handle according to claim 1, wherein said at least one cover plate is formed on each side of said core part.

7. A stick handle according to claim 1, wherein said at least one cover plate is formed from a laminate with reinforcement fibers.

8. A stick handle according to claim 7, wherein said laminate is chosen from the group consisting of carbon fiber, fiberglass laminate, wood veneer and plywood.

9. A stick handle according to claim 2, wherein said coating is formed from a laminate with reinforcement fibers.

10. A stick handle according to claim 9, wherein said laminate is chosen from the group consisting of carbon fiber, fiberglass laminate, wood veneer and plywood.

11. A stick handle according to claim 1, wherein said core part is formed from one of the group consisting of wood, polyurethane and polyvinyl chloride.

12. A stick handle according to claim 1, wherein said at least one cover plate is fixed onto the core part by gluing or winding.

13. A stick handle for an ice hockey stick having a longitudinal central axis, a blade, an upper end and a lower end, the lower end being situated adjacent to the blade of the stick, said handle comprising:

a core part having a substantially rectangular cross-section, said core part having a backed-off groove formed in at least one side of said core part along at least a portion of the length of the hockey stick substantially parallel to the longitudinal axis of the hockey stick, said groove opening in the center of said core part such that it forms an oblong cavity; and at least one cover plate fixed to said at least one side of said core part thereby covering said groove such that at least one closed cavity defined by said core part and said at least one cover plate is formed in the handle.

14. A stick handle according to claim 13, wherein said at least one cover plate is formed on each side of said core part.

15. A stick handle according to claim 13, wherein said at least one cover plate is formed from a laminate with reinforcement fibers.

16. A stick handle according to claim 15, wherein said laminate is chosen from the group consisting of carbon fiber, fiberglass laminate, wood veneer and plywood.

17. A stick handle according to claim 13, further comprising a coating which substantially surrounds the stick.

18. A stick handle according to claim 17, wherein said coating is formed from a laminate with reinforcement fibers.

19. A stick handle according to claim 13, wherein said core part is formed from one of the group consisting of wood, polyurethane and polyvinyl chloride.

20. A stick handle according to claim 13, wherein said at least one cover plate is fixed onto said core part by gluing or winding.

* * * * *